United States Patent [19]

Tamaki et al.

[11] Patent Number: 4,806,387

[45] Date of Patent: Feb. 21, 1989

[54] METHOD FOR COATING METAL PART WITH SYNTHETIC RESIN

[75] Inventors: Shigenori Tamaki, Toyota; Hiroyuki Machizuki, Aichi; Nobuo Kobayashi, Toyota; Takahiro Iwase, Anjyo; Naofumi Masuda, Nayoya, all of Japan

[73] Assignee: Toyota Jidosha Kabushiki Kaisha, Toyota, Japan

[21] Appl. No.: 893,143

[22] Filed: Aug. 5, 1986

[51] Int. Cl.[4] ..... B05D 1/24

[52] U.S. Cl. ..... 427/46; 427/185; 427/195; 118/DIG. 5

[58] Field of Search ..... 427/46, 195, 185; 118/DIG. 5

[56] References Cited

U.S. PATENT DOCUMENTS

| | | | |
|---|---|---|---|
| 3,227,636 | 1/1966 | De Hart | 427/185 |
| 3,261,707 | 7/1966 | Korski | 118/DIG. 5 |
| 3,309,217 | 3/1967 | Nagel | 427/195 |
| 3,383,233 | 5/1968 | Curcio | 427/379 |
| 3,419,409 | 12/1968 | Dettling | 427/185 |
| 3,431,887 | 3/1969 | Pettigrew | 118/406 |
| 3,514,308 | 5/1970 | Scott et al. | 427/185 |
| 3,925,570 | 12/1975 | Reinke et al. | 427/46 |
| 3,959,525 | 5/1976 | Sentementes et al. | 427/185 |
| 4,466,989 | 8/1984 | Haller et al. | 427/185 |

FOREIGN PATENT DOCUMENTS

| | | | |
|---|---|---|---|
| 682664 | 3/1964 | Canada | 427/185 |

OTHER PUBLICATIONS

Stott, Louis L., "Fluidized Bed Method of Coating", Organic Finishing (Jun. 1956) pp. 16–17.

"Powder Coating", Products Finishing (Oct. 1970) pp. 70–77.

B. Wiedemann, SAE Technical Paper Series (Development of Volkswagen's Supercharger G-Lader) Feb. 24–28, 1986.

*Primary Examiner*—Sam Silverberg
*Assistant Examiner*—Terry J. Owens
*Attorney, Agent, or Firm*—Oblon, Fisher, Spivak, McClelland & Maier

[57] ABSTRACT

A method of applying a synthetic resin layer to an outer surface of a metal part while the metal part is positioned within a powdered mass of a thermally fusible synthetic resin. The metal part within the powdered mass is induction-heated to a temperature between a melting point and a thermal decomposition point of the synthetic resin, to melt a portion of the powdered mass surrounding the outer surface of the heated metal part, and to deposit the molten portion of the powdered mass on the outer surface of the heated metal part, as the synthetic resin. The metal part is pushed down by a predetermined distance within the powdered mass, at least once at a point of time after the metal part has been positioned in the powdered mass, and before the induction-heating step has been completed.

8 Claims, 3 Drawing Sheets

METHOD FOR COATING METAL PART WITH SYNTHETIC RESIN

BACKGROUND OF THE INVENTION

1. Field of the Art

The present invention relates in general to a method for coating a metal part with a synthetic resin material, and more particularly to improvements in the art of applying a resin layer to an outer surface of a metallic core member to produce a resin-coated metal part, by positioning the core member heated to an elevated temperature within a powdered mass of a thermally fusible resin.

2. Description of Related Art

Various resin-coated metal parts are known. FIG. 6 shows an example of such resin-coated metal parts in the form of a pair of lobe-type rotors 4 for a rotary fluid machine of a Roots type such as a supercharger used on an engine of an automotive vehicle to increase volumetric efficiency by forcing a greater quantity of air into the cylinders. The supercharger has a housing which consists of a hollow housing body 2, and a pair of end plates (not shown) which close opposite open ends of the hollow housing body 2, and cooperate with the hollow housing body 2 to define an air-tight pump chamber 3. The housing rotatably supports a pair of parallel support shafts 6, 6 which support the corresponding lobe-type rotors 4, 4 accommodated in the pump chamber 3. The two lobe-type rotors 4, 4 are coupled to each other by a pair of timing gears (not shown) fixed to one end of the corresponding support shafts 6, 6, so that the two rotors 4, 4 are rotated in opposite directions at the same angular velocity, whereby air is sucked into the pump chamber 3 through an inlet 8 formed in the housing body 2, and the compressed air is discharged from the pump chamber 3 through an outlet 10 also formed in the housing body 2.

Each lobe-type rotor 4, 4 consists of a metallic core member 11 and a resin layer 12 of a suitable thickness which covers an outer peripheral surface and opposite end faces of the core member 11. The resin layer 12 is applied to minimize gaps between the two rotors 4, 4, and between the rotors 4, 4 and the inner surface of the housing body 2, and to thereby improve the volumetric efficiency of the supercharger. The core member 11 consists of a pair of lobes, and has a transverse cross sectional shape similar to the shape of a cocoon or peanut shell.

For applying such a synthetic resin coating (hereinafter called "resin layer") to the outer surface of a metallic core member, the present applicants have attempted to practice a method wherein the metallic core member is heated to a temperature higher than a melting point of a thermally fusible synthetic resin while the core member is positioned within a powdered mass of the synthetic resin, so that a portion of the powdered mass surrounding the outer surface of the core member is melted and deposited on the outer surace of the core member. To this end, the core member is immersed into the powdered mass of the synthetic resin accommodated in a container. Alternatively, the core member is first placed within the container and the powdered mass of the synthetic resin is introduced into the container, so as to embed the core member in the powdered mass. Subsequently, the metallic core member is induction-heated to a temperature higher than the melting point of the synthetic resin, by energizing a heating coil which is disposed around or within the container.

The above coating method permits formation of a resin layer on the outer surface of the metallic core member in an efficient manner with relatively simple and less costly equipment. The formed resin layer has a which sufficient in actual practice degree of adhesion to the metallic core member.

However, the applicants found that the above method of forming the resin layer on the metallic core member embedded within a powdered mass of the synthetic resin, with a portion of the powdered mass adjacent to the core member being kept in a molten state, provides uneven results. More specifically, the above method tends to fail to provide a resin layer having a sufficient thickness on the lower end face of the core member. Further, the above method is likely to suffer from the creation of an air gap at the interface of the metallic core member and the formed resin layer, which may cause an unsatisfactory bond between the resin layer and the core member.

The above defects occur particularly easily where the resin material is introduced into a resin container in which the core member of the rotor has already been set in position. However, the same defects may also be encountered where the core member is introduced into the powdered resin mass which has already been introduced into the container.

SUMMARY OF THE INVENTION

It is accordingly an object of the present invention to provide an improved method of applying a synthetic resin layer to an outer surface of a metal part which assures a sufficient thickness of the resin layer on the lower end face of the metal part and a sufficient force of adhesion of the resin layer to the lower end face of the metal part, and which may be practiced with a relatively simple apparatus.

According to the present invention, there is provided a method of applying a synthetic resin layer to an outer surface of a metal part, which includes the steps of: (a) placing the metal part within a powdered mass of a thermally fusible synthetic resin; (b) induction-heating the metal part within the powdered mass to a temperature between a melting point and a thermal decomposition point of the synthetic resin, thereby melting a portion of the powdered mass surrounding the outer surface of the heated metal part and depositing the molten portion of the powdered mass on the outer surface of the heated metal part, as the synthetic resin; (c) pushing down the metal part by a predetermined distance within the powdered mass at least once between an end of the step of placing the metal part within the powdered mass, and the end of the step of induction-heating the metal part; (d) and removing the metal part, coated with the synthetic resin layer, from the powdered mass.

In the method of the present invention described above, the metal part embedded in the powdered resin mass is pushed down in the powdered mass, during a period between the end of the step of placing the metal part in the powdered mass and the start of the induction-heating step, or in the process of the induction heating step. This downward movement of the metal part within the powdered mass permits the formation of the resin layer with a sufficient thickness, even on the lower end face of the metal part, and solves the previously indicated defect of an unsatisfactory bond between the resin layer and the core member. These favorable results seem to be derived from the reasons which will be described.

There exist micro or very minute spaces or pores between particles of the powdered resin mass. A portion of these spaces disappears due to melting of the particles and consequent adhesion to the outer surface of the metal part. As a result, the volume of the powdered resin mass is reduced. Although reduced volumes near the upper end face and the peripheral surface of the metal part are comparatively easily compensated for by flows of the resin particles, such flows of the particles are comparatively difficult near the lower end face of the metal part. Consequently, as depicted in FIG. 5 in an exaggerated fashion, there is formed a void 18 between the powdered mass 17 and a portion of the resin layer 16 which has been deposited on the lower surface of the metal part 14. In this condition, The resin layer 16 is unable to grow any more. Alternatively, the spaces between the particles of the resin below the formed resin layer 16 are enlarged, whereby the thermal conduction of the portion of the resin mass 17 below the resin layer 16 is reduced, and the rate of growth of the resin layer 16 is lowered, or the resin layer 16 is given an unsatisfactory quaity due to excessive porosity. According to the present method of the invention, however, the downward movement of the metal part 14 will cause the void 18 to be effectively eliminated, or contribute to minimizing the spaces between the resin particles below the lower surface of the metal part 14, thereby enabling the resin layer 16 to normally grow.

According to one feature of the invention, the method further comprises a step of effecting a preliminary heating of the metal part to a temperature higher than the melting point of the synthetic resin before the metal part has been placed within the powdered mass. In this case, the downward movement of the metal part is preferably effected at a suitable length of time after the placement of the metal part within the powdered mass, so that the resin layer is given a suitable amount of thickness before the metal part is pushed down. As a matter of course, the metal part within the powdered mass muut be kept at a temperature higher than the melting point of the resin.

It is also possible that the metal part is first embedded in the powdered mass, and thereafter heated to a temperature higher than the melting point of the resin material. In this case, it is desirable to start the downward movement of the metal part after the above-indicated temperature has been reached. However, the downward movement of the metal part may be started before the induction-heating step is initiated. In this instance, too, the principle of the invention may be more or less practiced since the density of the powdered mass is increased at its portion under the metal part as compared with that at its portions surrounding the upper end face and the peripheral surface of the metal part.

According to another feature of the invention, the metal part is immersed into the powdered mass while the powdered mass is maintained in a fluid state. In this case it is preferred to discontinue the fluid state of the powdered mass before initiating the induction-heating step, and initiate the downward movement of the metal part after the fluid state of the powdered mass is discontinued.

According to a further feature of the invention, the metal part is placed into a resin container, and the powdered mass is subsequently introduced into the container so as to embed the metal part in the powdered mass. In this case, the downward movement of the metal part is particularly effective, because a space under the metal part is comparatively difficult to be filled with the resin powder.

The instant method is suitably practiced on a core member of a rotor for a rotary fluid machine of a Roots type, in which the rotor has an axis of rotation and flat opposite end faces which are perpendicular to the axis of rotation. In this instance, the metal part in the form of the rotor is immersed into the powdered mass such that the axis of rotation is oriented vertically. In this case, a bore or bores which is/are formed through the core member parallel to its axis of rotation and open in its flat opposite end faces are preferably closed at the opposite open ends by suitable closure members before the core member is placed into the powdered mass.

BRIEF DESCRIPTION 0F THE DRAWINGS

The foregoing and other objects, features and advantages of the present invention will be better understood with reference to the following detailed description of a preferred embodiment of the invention, when considered in connection with the accompanying drawings, in which.

DESCRIPTION OF THE PREFERRED EMBODIMENTS

Referring to the accompanying drawings, there will be described the preferred embodiment of the present invention, in which a synthetic resin material is applied to an outer surface of a metal part in the form of a metallic core member of a lobe-type rotor as indicated at 4 in FIG. 6.

Figure 3:
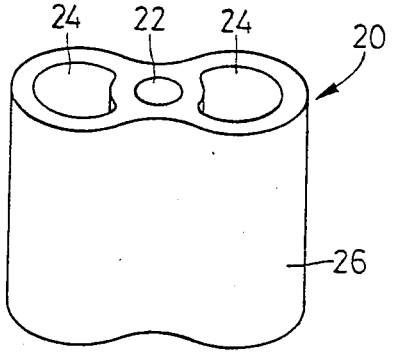
FIG. 3 is a perspective view of the workpiece or metallic part in the form of a metallic core member of a lobe-type rotor.

The metallic core member (hereinafter referred to as "workpiece") is generally indicated at 20 in FIG. 3. The core member 20 has a transverse cross sectional shape similar to the shape of a cocoon or peanut shell, and is made of an aluminum alloy, more precisely, an aluminum-silicon alloy having a silicon content as high as about 12% (according to Japanese Industrial Standards, JIS A 4047, for example). The core member 20 has a central axial bore 22, which defines an axis of rotation of the lobe-type rotor. The core member 20 further has two axial bores 24, 24 which are formed parallel to the central axial bore 22, so as to extend through a pair of lobe portions of the core member 20 on diametrically opposite sides of the central bore 22. These additional bores 24 are provided for reducing the weight of the rotor 4. Each of the bores 22, 24 11 opens on flat opposite end faces of the core member 20.

According to the present invention, the metallic core member or workpiece 20 is covered with a resin layer. More specifically, the outer peripheral surface and the outer parts of the opposite end faces of the workpiece 20 are coated with a thermally fusible synthetic resin, for example, a powder of AFLON (registered trademark) which is a copolymer of tetrafluoroethylene and ethylene. The outer surface of the workpiece 20 to be coated with such a synthetic resin material is indicated at 26 in FIG. 3.

The outer surface 26 of the workpiece 20 to be covered by a resin layer is preferably pre-treated before the resin material is applied thereto. The outer surface 26 may be pre-treated by degreasing and subsequent water rinsing. For increased adherence of the resin layer to the outer surface 26, however, it is advisable that the pre-treatment comprises: preliminary washing and subsequent drying of the outer surface 26; bombarding particles of hard substances onto the dried outer surface 26 at a high speed, so as to create a multiplicity of concavities in the surface 26; degreasing the surface 26 with an alkalescent degreasing agent; and water rinsing the surface 26 to remove the degreasing agent.

Figure 1:
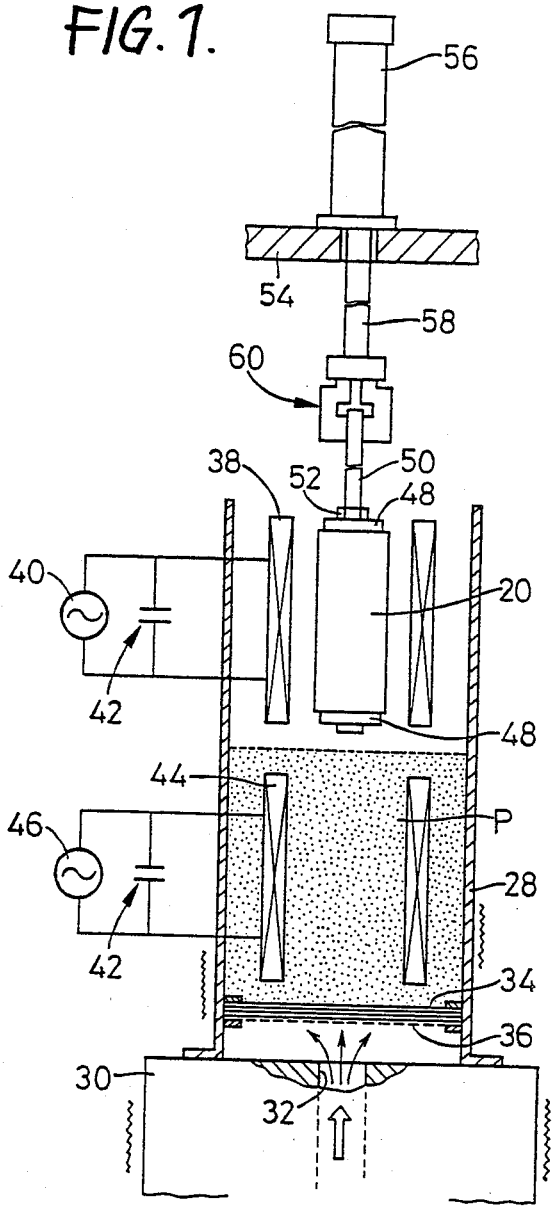
FIG. 1 is a schematic elevational view in cross section of an apparatus adapted to practice a method of the present invention, showing a step of induction-heating a workpiece.

After the workpiece 20 is finally dried, the resin layer is applied to the pre-treated outer surface 26, by an apparatus schematically illustrated in FIG. 1.

In FIG. 1, reference numeral 28 designates a container in which a powdered mass P of AFLON is accommodated. In this modified embodiment, the workpiece 20 is subjected to a preliminary heating step (which will be described), before it is immersed into the powdered mass P maintained in a fluid state. To improve the fluidity of the powdered mass P, the container 28 mounted on an oscillating device 30 is oscillated while compressed air is blown into the powdered mass P through a passage 32 formed in the oscillating device 30 and the bottom of the container 28. The oscillatory movements of the container 28 and the powdered mass P act to reduce friction of the resin particles of the powdered mass P which are supported or levitated by the upward flows of the compressed air through the powdered mass P. Thus, the oscillation of the powdered mass P is combined with the upward flows of the compressed air to enhance the fluidity of the powdered mass P.

Various known oscillators such as a mechanical oscillator using an unbalancing weight may be used as the oscillating device 30. Preferably, the oscillating device 30 is operated at an oscillating frequency within an approximate range of 1500–2000 Hz, and at an acceleration within an approximate range of 2.5–3.0 G. The container 28 has a gas-permeable bottom in the form of an air filter 34 for uniform distribution of the air from the passage 32 into the powdered mass P. The air filter 34 must have a texture which is fine enough to avoid a channeling phenomenon in which wide fluid paths are formed in the portions of the powdered mass P at which the flow resistance is comparatively low. In the present embodiment, the air filter 34 consists of a plurality of semi-transparent parchment paper sheets superposed on each other (for example, 15 sheets). The parchment paper is usually used as tracing paper in drafting of drawings. The air filter 34 is supported by a net 36 at the bottom of the container 28.

In an upper half of the container 28 which is not filled with the powdered mass P, an upper induction heating coil 38 for preliminary heating of the workpiece 20 is fixedly disposed. This heating coil 38, which is similar to a coil used for induction hardening, is positioned so as to surround the workpiece 11 when placed in its preliminary heating position of FIG. 1, such that the heating coil 38 is spaced a suitable distance away from the periphery of the workpiece 20. With the upper coil 38 energized by a power supply 40, the workpiece 20 is induction-heated. For an improved power factor of the power supply circuit, a capacitor 42 is provided between the power supply 40 and the coil 38, in parallel connection with the power supply 40. The upper induction heating coil 38 has a coolant passage (not shown) formed therein to circulate a coolant. The coil 38 is mounted on a bracket (not shown) which is supported by a suitable suspension member fixed to a member outside the container 28.

Below the upper induction heating coil 38, a lower induction heating coil 44 is fixedly disposed within the powdered mass P, so that the workpiece 20 immersed or embedded in the powdered mass P is surrounded by the coil 44 and induction-heated when the coil 44 is energized by a power supply 46. Like the upper coil 38, this lower coil 44 is supported by a suitable suspension member such as wires or a bracket. Although the upper and lower coils 38, 44 may be fixed to the container 28 by means of brackets or faceplates, it is desired that the coils 38, 44 be supported by a member other than the container 28, since the container 28 is oscillated by the oscillating device 30.

As noted earlier, closure members 48, 48 are used to close the open ends of the axial bores 24, 24 formed in the workpiece 20. However, a support rod 50 is inserted through the central axial bore 22 in the workpiece 20 such that the head of the rod 50 is in abutment on the lower closure member 48. The closure member 48, 48 and the rod 50 are fixed to the workpiece 20 by tightening a nut 52 which engages an externally threaded portion of the rod 50. The closure members 48, 48 are preferably formed of asbestos mixed with a cement, made of ceramics and coated with a suitable resin such as tetrafluoroethylene, or made of brass, stainless steel or other metallic materials which are difficult to be induction-heated, or formed of a heat resistant resin which is not deformed by heat from the heated workpiece 20. Similar metallic or resin materials are used for the support rod 50 and the nut 52. At any rate, the materials for the closure and support members 48, 50, 52 are selected so as to protect these members from deposition of the synthetic resin of the powdered mass P.

Above the container 28, there is provided a stationary member 54 on which a cylinder 56 is mounted such that its piston rod 58 extends downward toward the container 28. The piston rod 58 carries at its end suitable means for holding the upper end of the support rod 50. For example, the piston rod 58 is equipped with a chuck 60 as illustrated in FIG. 1, or provided at its end with a tapered bore which fits the tapered upper end of the rod 50. In the latter case, a pin or screw is used to maintain the engagement of the tapered end of the rod 50 with the tapered bore of the piston rod 58.

The operation according to the method of the invention of the apparatus of FIG. 1 constructed as described above will now be described, referring further to FIG. 2.

The metal part or workpiece 20 whose outer surface 26 is pre-treated as previously described is supported together with the enclosure members 48, 48, with the support rod 50 connected to the piston rod 58. The cylinder 56 is first activated to hold the workpiece 20 in its preliminary heating position of FIG. 1, at which the workpiece 20 is surrounded by the upper induction heating coil 38. In this condition, the upper coil 38 is energized to induction-heat the workpiece 20 to a temperature above the melting point of the synthetic resin of the powdered mass P. In the instant case where a copolymer of tetrafluoroethylene and ethylene (AFLON) is used, the workpiece 20 is heated to a temperature higher than the melting point of 260° C. of the AFLON. For a better quality resin layer to be formed, and for higher coating efficiency, it is advisable that the heating temperature of the workpiece 20 is held at a level below the thermal decomposition point of the AFLON, i.e., 360° C., preferably within a range of 300°-340° C., and more preferably in the neighborhood of 340° C. However, the workpiece 20 may be heated to a point just below 360°, as the workpiece 20 is cooled while the workpiece 20 is immersed into the powdered mass P in the subsequent step. The preliminary heating of the workpiece 20 by the upper coil 38 is accomplished, for example, by applying an electric current of about 3 KHz to the coil 38 for about 120 seconds. In this case, the workpiece 20 may be heated substantially uniformly at its outer portion, and at its inner portion to some extent.

The workpiece 20 subjected to the preliminary heating by the upper coil 38 is then lowered, by a further downward movement of the piston rod 58, so that the workpiece 20 is embedded within the powdered mass P. This movement of the workpiece 20 into the powdered mass P is facilitated by an oscillatory movement of the powdered mass P via the container 28, and upward air flows into the powdered mass P through the air filter 34. Namely, the workpiece 20 is easily immersed into the powdered mass kept in a fluid state. During the immersion of the workpiece 20 into the powdered mass P, the power supply 46 for the lower coil 44 is held off.

While the workpiece 20 is being immersed into the powdered mass P, the outer surface 26 of the workpiece 20 heated above the melting point of the powdered mass P contacts the powdered mass P with a relative movement therebetween. Consequently, the synthetic resin contacting the outer surface 26 is instantaneously melted and deposited on the surface 26 as a thin molten resin layer, without voids left in the molten resin layer. Even if voids are produced in the molten portion of the powdered mass P adjacent to the outer surface 26, such voids are moved along the surface 26, due to the relative movement of the workpiece 20 relative to the powdered mass P, whereby the voids do not prevent the molten synthetic resin from adhering to specific parts of the outer surface 26.

Figure 2:
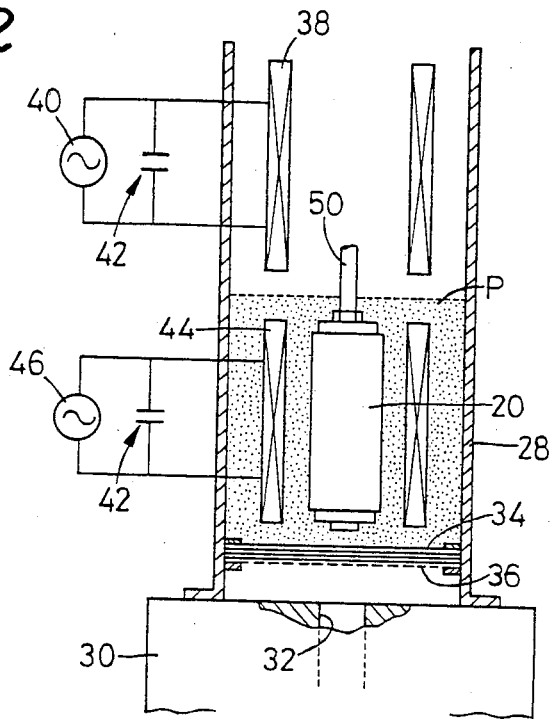
FIG. 2 is a schematic elevational view of the apparatus of FIG. 1, showing a step of applying a resin layer to an outer surface of the workpiece.

By about 20-30 seconds after the start of movement of the workpiece 20 toward the powdered mass P, the workpiece 20 has been completely immersed in the powdered mass P, that is, moved to the position of FIG. 2 at which the workpiece 20 is surrounded by the lower induction heating coil 44. At this time, the oscillating device 30 is turned off, and the air supply from the passage 32 is discontinued. The melting of the synthetic resin adjacent to the workpiece 20 continues in the position of FIG. 2. If the powdered mass P were to be kept in a fluid state at this time, air channels would tend to be formed at the interface of the outer surface 26 and the powdered mass P, which channels would prevent deposition of the molten resin onto the corresponding parts of the surface 26. For this reason, the air blast into the powdered mass P and the oscillation of the container 28 are discontinued when the workpiece 20 has been completely immersed in the powdered mass P.

After the workpiece 20 has been fully immersed in the powdered mass P and the powdered mass P has been brought to a non-fluid state, the workpiece 20 is left in the powdered mass P for a suitable time, for example, 60 seconds, without energization of the lower coil 44. In this holding time period, an additional amount of the synthetic resin is melted and deposited on the surface 26 of the workpiece 20, whereby the thickness of the molten resin layer adhering to the surface 26 of the workpiece 20 is gradually increased. Since there exist very minute spaces or pores between the resin particles of the powdered mass P, the volume of the mass P is reduced as the molten resin is deposited on the surface 26 of the workpiece 20. The reduced volume of the portions of the powdered mass P adjacent to the upper end face and peripheral surface of the workpiece 20 may be comparatively readily compensated for by flows of the resin particles toward the end face and peripheral surface of the workpiece 20, whereby the resin layer is formed as contemplated, on the end face and peripheral surface of the workpiece 20.

The situation is different with respect to the portion of the powdered mass P under or adjacent to the lower end face of the workpiece 20. Namely, the resin particles under the lower end face of the workpiece 20 cannot easily flow so as to compensate for the existance of spaces between the resin particles due to melting and deposition of the resin material on the lower end face of the workpiece 20. Consequently, the portion of the powdered mass P adjacent to the lower end face of the workpiece 20 tends to have a relatively low density. A void may even be formed between the already deposited resin layer and the portion of the powdered mass P under the lower end face of the workpiece 20. The reduction in the desity of the portion of the powdered mass P adjacent to the lower end face of the workpiece 20 will result in a decrease in its thermal conductivity, thereby reducing a rate of growth of the resin layer on the lower end face of the worpiece 20, or causing pores to be left within the mass of the formed resin layer. In such a case, an air gap or void is formed between the deposited resin layer and the powdered mass P and the growth of the resin layer is discontinued.

Figure 4:
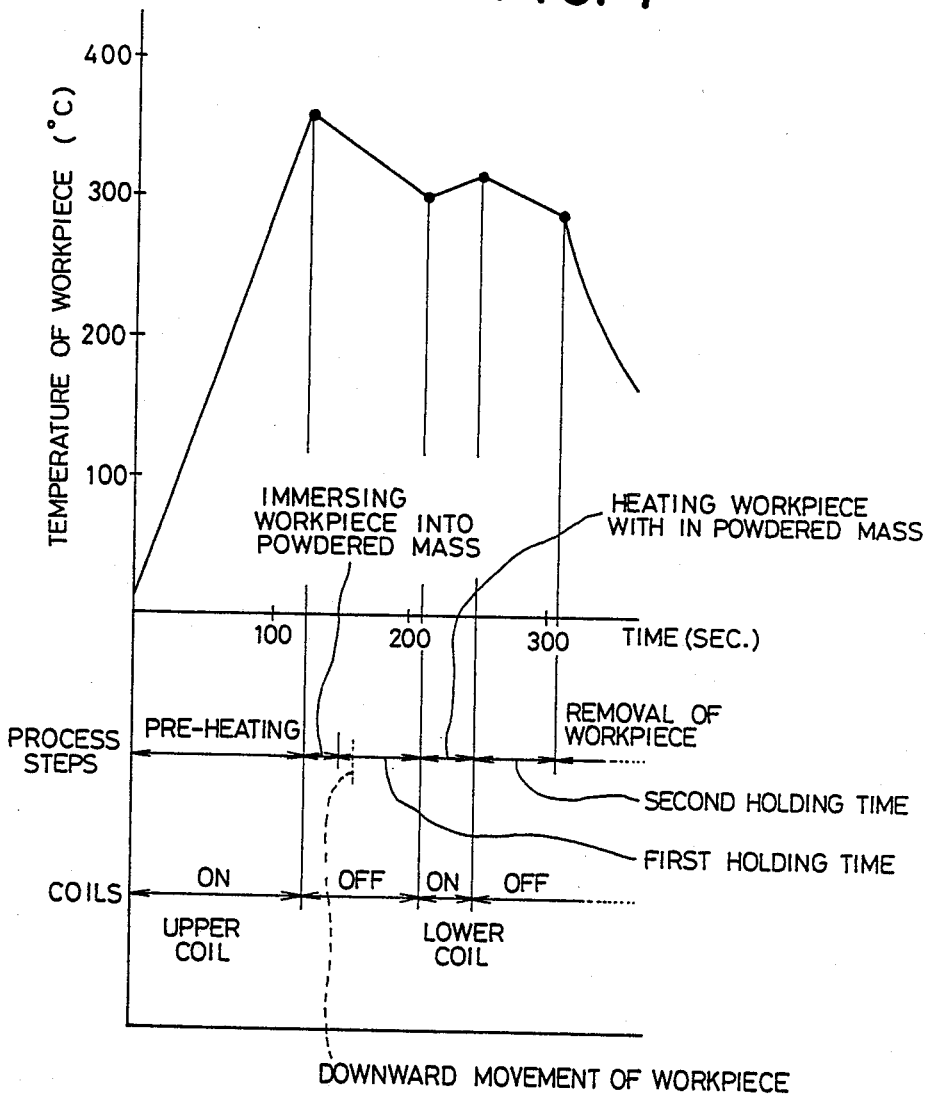
FIG. 4 is a graph showing the different steps of the method, in relation to the temperature of the workpiece varying with the time.

To obviate the defects mentioned above, the workpiece 20 is moved down by a predetermined small distance within the powdered mass P, according to the principle of the invention. This downward movement of the workpiece 20 is effected during an initial period of the holding time previously indicated, as indicated in FIG. 4. With the downward movement of the workpiece 20, the density of the portion of the powdered mass P under the lower end face of the workpiece 20 is increased, or the air gap under the workpiece 20 is eliminated. As a result, the downward movement of the workpiece 20 permits a continuous growth of the partially deposited resin layer, and an increased bond between the resin layer and the lower end face of the workpiece 20.

While the workpiece 20 is immersed into the powdered mass P and is held therein with the lower induction heating coil 44 kept off, the temperature of the workpiece 20 gradually drops, as indicted in FIG. 4. To keep the workpiece 20 at a temperature within a predetermined range, the workpiece 20 is re-heated with the power supply 46 turned on, when the workpiece 20 has cooled below 300° C., for example. Namely, an induction current of about 3 KHz frequency for example is applied to the lower induction heating coil 44 for a suitable period of time (40 seconds, for example) to re-heat the workpiece 20 up to 320° C., for example, as also indicted in FIG. 4.

Then, the workpiece 11 is left in the powdered mass P for 60 seconds, for example, with the lower coil 44 kept deenergized. With the re-heating of the workpiece 20 and the subsequent hold time, the molten resin layer adhering to the outer surface 26 of the workpiece 20 further develops. In this specific example, the sum of the first holding time prior to the re-heating, the re-heating time and the second holding time subsequent to the re-heating, amounts to about 2–3 minutes. During this time period, the resin layer to be formed is given a thickness of about 1.2 mm. The re-heating time and the holding times are selected so as to obtain a desired thickness of the resin layer. The second holding time following the re-heating time is provided for maximum utilization of the thermal energy given to the workpiece 20 for deposition of the synthetic resin on the workpiece 20. If a reduction in the cycle time is preferred to an increase in thermal efficiency, the workpiece 20 may be taken out of the powdered mass P immediately after the termination of the re-heating step.

The workpiece 20 coated with the resin layer of a desired thickness is then removed from the powdered mass P with the upward movement of the piston rod 58 of the cylinder 56 (FIG. 1). This removal of the workpiece 20 is accomplished while the powdered mass P is kept in a fluid state, as in the step of immersing the workpiece 20 into the powdered mass P. That is, the oscillating device 30 is turned on and the compressed air is supplied through the passage 32, before the cylinder 56 is activated to raise the workpiece 20. In this way, the workpiece 20 is easily removed from the powdered mass P.

After the removal of the workpiece 20 from the powdered mass P, the resin layer covering the workpiece 20 is subjected to necessary treatments. The thus formed resin layer has minimum voids or pores and comparatively high adhesion to the surface of the metallic core member 20, assuring improved quality for the lobe-type rotor. Further, the slight downward movement of the workpiece 20 during formation or deposition of the resin layer is conducive to an increase in the density of the portion of the powdered mass P under the workpiece 20, and to elimination of a void or air gap between the workpiece 20 and the powdered mass P. Hence, the instant method assures a sufficient thickness of the resin layer even on the lower end face of the workpiece 20.

While the illustrated embodiment is adapted to effect a downward movement of the workpiece 20 after the workpiece 20 has been immersed into the powdered mass P, or during the initial period of the first holding time, this downward movement of the workpiece 20 may be effected at any suitable time after the fluid state of the powdered mass P has been discontinued. Further, the downward movement of the workpiece 20 may be achieved two or more times.

It is possible that the power supply 46 is turned on energize the lower induction heating coil 44 for re-heating the workpiece 20, upon initiation of immersion of the workpiece 20, or immediately after the completion of the immersion, in order to maintain the workpiece 20 substantially at the predetermined temperature.

Further, only one of the air blast into the powdered mass P, or only the oscillation of the container 28 by the oscillating device 30 may be used to keep the powdered mass P in a fluid state. However, it is preferable to use both the air blast and the oscillation, in view of the problems that are encountered if only one of the above two means is utilized for improving the fluidity of the powdered mass P. Described in more detail, the inner portion of the powdered mass P is difficult to be sufficiently oscillated by the oscillating device 30 without the air blast into the powdered mass P. On the other hand, the air blast tends to cause air channeling paths in the portions of the powdered mass P having a relatively low resistance to the air flow, if the powdered mass P is not oscillated.

Although the apparatus illustrated in FIGS. 1 and 2 uses two induction heating coils in the form of the upper and lower coils 38, 44, the apparatus may be provided with a single coil which is adapted to be movable between an upper position for effecting the preliminary heating and the second re-heating, and a lower position for effecting the re-heating of the workpiece within the powdered mass.

While the illustrated embodiments are adapted to move the workpiece 11 into the powdered mass 42 contained in the stationary container 30 or 58, it is possible that the container is adapted to be movable relative to the workpiece 11 held at a fixed position.

Another alternative method for placing the workpiece 20 within the powdered mass P comprises the steps of positioning the workpiece 20 in an empty container, and filling the container with a powdered mass of a synthetic resin material so as to embed the workpiece 20 in the powdered mass. In this instance, the portion of the powdered mass below the workpiece 20 is difficult to be dense, and therefore a downward movement of the workpiece 20 after the embedment within the powdered mass is particularly effective for ensuring a sufficient thickness of the resin layer to be formed on the lower end face of the workpiece 20. The number and the time of the downward movement of the workpiece 20 are suitably selected, as in the case where the workpiece 20 is immersed into the powdered mass P which has been accommodated in the container 28.

Figure 6:
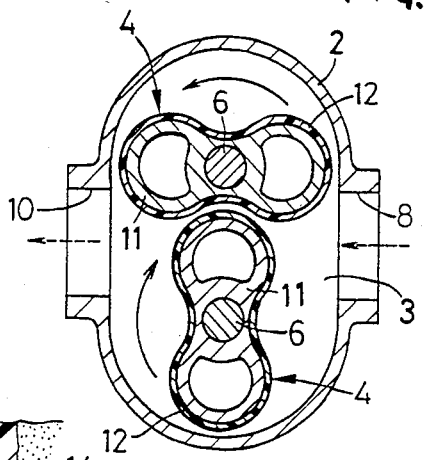
FIG. 6 is an elevational view in cross section of an example of a rotary fluid machine of a Roots type in the form of a supercharger using lobe-type rotors, to which the present invention is applicable.
Figure 5:
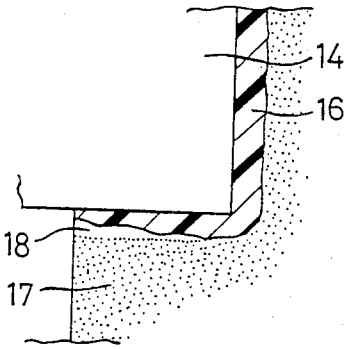
FIG. 5 is a view explaining an effect of a step of pushing down the workpiece according to the method.

In the illustrated embodiment, the workpiece 20 (metallic core member of a lobe-type rotor as indicated at 4 in FIG. 6) is made of an aluminum alloy as previously described. However, the principle of the present invention is also applicable to a workpiece made of other materials such as steels. When the workpiece is an aluminum part, i.e., has a relatively small thermal capacity and is easily cooled, the previously described re-heating step is desired. However, when the workpiece is a steel part, which is difficult to be cooled, the re-heating step is not always necessary. The re-heating step is also unnecessary when the desired thickness of a resin layer to be formed is relatively small. Further, the heating of the workpiece 20 outside the powdered mass P may be made by other heating means or methods, such as those utilizing the principles of radiation, convection or conduction of heat, for example, by an electric heater, or a furnace utilizing combustion heat.

While the illustrated embodiment uses as a synthetic resin material a fluorethylene resin (such as AFLON which is a copolymber of tetrafluoroethylene and ethylene), the principle of the present invention may be practiced not only with other thermoplastic resin materials such as nylon and polyethylene, but also with thermosetting resin.

Although the workpiece 20 handled in the illustrated embodiments is a metallic core member of a lobe-type rotor of a rotary pump of a Roots type, the method and apparatus of the invention may be adapted to handle other types of metallic rotors for Roots-type or other rotary fluid machines or other kinds of metallic workpieces.

While the present invention has been described in its preferred embodiments with a certain degree of particularity, it is to be understood that the invention is by no means confined to the precise details of the illustrated embodiments, but may be embodied with various other changes, modifications and improvements which may occur to those skilled in the art, without departing from the spirit and scope of the invention defined in the appended claims.

What is claimed is:

1. A method of applying a synthetic resin layer to an outer surface of a metal part, comprising the steps of:

positioning said metal part in a stationary position within a powdered mass of a thermally fusible synthetic resin;

induction-heating said metal part within said powdered mass to a temperature between a melting point and a thermal decomposition point of said synthetic resin, thereby melting a portion of said powdered mass surrounding said outer surface of the heated metal part and coating the molten portion of said powdered mass on said outer surface of said heated metal part as said synthetic resin layer;

using mechanical pushing means for pushing down said metal part to move downwardly said metal part by a predetermined distance within said powdered mass while said powdered mass is maintained in a non-fluidized and non-aerated state, said pushing down of said metal part being effected at least once and at a point of time after an end of said step of positioning said metal part within said powdered mass and before an end of said step of induction-heating said metal part; and removing said metal part, coated with said synthetic resin layer, from said powdered mass.

2. A method according to claim 1, wherein said step of pushing down said metal part is performed between the end of said step of positioning said metal part within said powdered mass, and a start of said step of induction-heating said metal part.

3. A method according to claim 1, wherein said step of pushing down said metal part within said powdered mass is effected during said step of induction-heating said metal part.

4. A method according to claim 1, including the step of performing a preliminary heating of said metal part to a temperature higher than the melting point of said synthetic resin before said step of positioning placing said metal part within said powdered mass.

5. A method according to claim 1, wherein said step of positioning said metal part within said powdered mass comprises immersing said metal part into said powdered mass while maintaining said powdered mass in a fluid state, further comprising the step of discontinuing said fluid state of said powdered mass before starting said step of induction-heating said metal part.

6. A method according to claim 1, wherein said step of positioning said metal part within said powdered mass comprises placing said metal part within a container, and subsequently introducing said powdered mass into said container so as to embed said metal part within said powdered mass.

7. A method according to claim 1, wherein said metal part comprises a core member of a rotor for a rotary fluid machine of a Roots type, said rotor having an axis of rotation and flat opposite end faces which are perpendicular to said axis of rotation, and wherein said step of positioning said metal part comprises immersing said rotor into said powdered mass such that said axis of rotation is oriented vertically.

8. A method according to claim 7, wherein said said core member has at least one bore formed therethrough parallel to said axis of rotation, said bore opening into said flat opposite end faces, and which further comprises the step of closing opposite open ends of said at least one bore with closure means before placing said core member into said powdered mass.

* * * * *